US009790661B2

(12) United States Patent
Hand et al.

(10) Patent No.: US 9,790,661 B2
(45) Date of Patent: Oct. 17, 2017

(54) HYDRAULIC SYSTEM HAVING DUAL TILT BLADE CONTROL

(71) Applicant: Caterpillar Inc., Peoria, IL (US)

(72) Inventors: Timothy L. Hand, Metamora, IL (US); Heather Armistead, Peoria, IL (US); Fuaad Sayeed, Peoria, IL (US); Srikalyan C. Puranam, Naperville, IL (US); Stephen Garnett, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 311 days.

(21) Appl. No.: 14/551,569

(22) Filed: Nov. 24, 2014

(65) Prior Publication Data

US 2015/0081179 A1 Mar. 19, 2015

Related U.S. Application Data

(62) Division of application No. 13/291,287, filed on Nov. 8, 2011, now Pat. No. 8,893,818.

(Continued)

(51) Int. Cl.
*E02F 3/84* (2006.01)
*F15B 13/04* (2006.01)

(Continued)

(52) U.S. Cl.
CPC ..... *E02F 3/844* (2013.01); *E02F 3/7609* (2013.01); *E02F 3/815* (2013.01); *E02F 3/845* (2013.01);

(Continued)

(58) Field of Classification Search
CPC ..... E02F 3/7609; E02F 3/7618; E02F 3/815; E02F 3/844; E02F 3/845; E02F 9/2004;

(Continued)

(56) References Cited

U.S. PATENT DOCUMENTS 4,802,537 A 2/1989 Ryerson
5,010,961 A 4/1991 Frisbee (Continued)

FOREIGN PATENT DOCUMENTS

CN 201144909 11/2008
JP 2005133537 5/2005
JP 2009052285 3/2009

*Primary Examiner* — Logan Kraft
(74) *Attorney, Agent, or Firm* — Finnegan, Henderson, Farabow, Garrett & Dunner, L.L.P.

(57) ABSTRACT

A hydraulic system for a machine is disclosed. The hydraulic system may have a tank configured to hold a supply of fluid, a pump configured to draw fluid from the tank and pressurize the fluid, a first cylinder operatively connected between a first side of a work tool and an undercarriage of the machine, and a second cylinder operatively connected between a second side of the work tool and the undercarriage of the machine. The hydraulic system may also have a first electro-hydraulic valve associated with the first cylinder and configured to selectively regulate a flow of pressurized fluid to the first cylinder independently of the second cylinder, and a second electro-hydraulic valve associated with the second cylinder and configured to selectively regulate a flow of pressurized fluid to the second cylinder independently of the first cylinder.

10 Claims, 3 Drawing Sheets

Related U.S. Application Data

(60) Provisional application No. 61/424,250, filed on Dec. 17, 2010.

(51) Int. Cl.

| | |
|---|---|
| ***E02F 9/22*** | (2006.01) |
| ***F15B 13/043*** | (2006.01) |
| ***E02F 3/815*** | (2006.01) |
| ***E02F 9/20*** | (2006.01) |
| ***F15B 11/16*** | (2006.01) |
| ***E02F 3/76*** | (2006.01) |

(52) U.S. Cl.

CPC ..... *E02F 9/2004* (2013.01); *E02F 9/2235* (2013.01); *E02F 9/2285* (2013.01); *E02F 9/2296* (2013.01); *F15B 11/163* (2013.01); *F15B 13/043* (2013.01); *F15B 13/0416* (2013.01); *F15B 2211/30535* (2013.01); *F15B 2211/3111* (2013.01); *F15B 2211/3144* (2013.01); *F15B 2211/329* (2013.01); *F15B 2211/6054* (2013.01)

(58) Field of Classification Search

CPC ..... E02F 9/22; E02F 9/2235; E02F 9/2285; E02F 9/2296; F15B 11/163; F15B 13/0416; F15B 13/043; F15B 2211/30535; F15B 2211/3111; F15B 2211/3144; F15B 2211/329; F15B 2211/6054

See application file for complete search history.

(56) References Cited

U.S. PATENT DOCUMENTS

| | | | | |
|---|---|---|---|---|
| 5,083,428 | A | 1/1992 | Kubomoto et al. | |
| 5,277,027 | A | 1/1994 | Aoyagi et al. | |
| 5,331,882 | A * | 7/1994 | Miller | F15B 11/003 91/461 |
| 5,620,053 | A | 4/1997 | Kamikawa et al. | |
| 5,678,470 | A | 10/1997 | Koehler et al. | |
| 5,682,955 | A | 11/1997 | Groth et al. | |
| 5,852,934 | A | 12/1998 | Chung et al. | |
| 5,896,943 | A | 4/1999 | Christensen | |
| 6,035,241 | A | 3/2000 | Yamamoto | |
| 6,065,365 | A * | 5/2000 | Ostler | B60K 25/00 702/94 |
| 6,129,155 | A * | 10/2000 | Lombardi | E02F 3/845 172/2 |
| 6,129,157 | A | 10/2000 | Noonan et al. | |
| 6,481,506 | B2 * | 11/2002 | Okada | E02F 9/22 172/812 |
| 6,644,025 | B1 | 11/2003 | Oberhausser et al. | |
| 6,698,523 | B2 | 3/2004 | Barber | |
| 6,820,355 | B2 | 11/2004 | Yoshino et al. | |
| 6,901,754 | B2 | 6/2005 | Jervis | |
| 6,945,335 | B2 * | 9/2005 | Suzuki | E02F 9/2235 172/812 |
| 7,059,124 | B2 | 6/2006 | Suzuki et al. | |
| 7,729,835 | B2 * | 6/2010 | Morris | E02F 9/2004 172/50 |

* cited by examiner

HYDRAULIC SYSTEM HAVING DUAL TILT BLADE CONTROL

RELATED APPLICATIONS

This application is a divisional of application Ser. No. 13/291,287, filed Nov. 8, 2011, which claims the benefit of U.S. Provisional Application No. 61/424,250, filed Dec. 17, 2010, the contents of both which are expressly incorporated herein by reference.

TECHNICAL FIELD

The present disclosure relates generally to a hydraulic system, and more particularly, to a hydraulic system having dual tilt blade control.

BACKGROUND

Some earth moving machine, for example dozers, motor graders, and snow plows, have a front-mounted work tool such as a blade, bucket, or plow for pushing or carrying material. These work tools can be tilted about a horizontal axis generally perpendicular to the work tool by one or more tilt cylinders, and pitched about a horizontal axis parallel to the work tool by dual cylinders located to either side of the work tool. Tilting may be accomplished by extending and retracting a single cylinder or extending one paired cylinder while retracting the other paired cylinder. Pitching can be separately accomplished by extending or retracting both paired cylinders in the same direction at the same time. Existing hydraulic systems utilize different combinations of manual and/or pilot control valves to regulate the tilting and pitching operations.

An exemplary hydraulic system having tilt control is disclosed in U.S. Pat. No. 6,481,506 (the '506 patent) issued to Okada et al. on Nov. 19, 2002. Specifically, the '506 patent discloses a hydraulic system having a left tilt cylinder and a right tilt cylinder connected between straight side frames of a machine and outer edges of a blade. The hydraulic system also includes a left cylinder actuation switching valve (LCASV), a right cylinder actuation switching valve (RCASV), a left post-pressure compensating valve associated with the LCASV, a right post-pressure compensating valve associated with the RCASV, and a pilot switching valve. Each of the LCASV and RCASV are pilot-operated valves configured to move between first positions at which pressurized fluid from a pump is directed into head-ends of the associated tilt cylinders, and second positions at which pressurized fluid is directed into rod-ends of the associated tilt cylinders. The pilot switching valve is a solenoid-operated valve movable between a first position at which the head-ends of both the LCASV and RCASV receive the same pilot pressure, and a second position at which the head-end of the LCASV and the rod-end of the RCASV receive the same pilot pressure. In this configuration, the hydraulic system may be capable of separately implementing a pitch operation utilizing both LCASV and RCASV, a single-tilt operation using only LCASV, or a dual-tilt operation using LCASV and RCASV.

Although the system of the '506 patent may be capable of separately implementing both tilt and pitch operations, it may still be limited. That is, the system of the '506 patent may not be capable of simultaneously tilting and pitching, or of accomplishing single-tilt operations using only the RCASV. These limitations may reduce functionality of the associated machine.

The hydraulic system of the present disclosure addresses one or more of the needs set forth above and/or other problems of the prior art.

SUMMARY

In one aspect, the present disclosure is directed to a hydraulic system. The hydraulic system may include a tank configured to hold a supply of fluid, a pump configured to draw fluid from the tank and pressurize the fluid, a first cylinder operatively connected between a first side of a work tool and an undercarriage of the machine, and a second cylinder operatively connected between a second side of the work tool and the undercarriage of the machine. The hydraulic system may also include a first electro-hydraulic valve associated with the first cylinder and configured to selectively regulate a flow of pressurized fluid to the first cylinder independently of the second cylinder, and a second electro-hydraulic valve associated with the second cylinder and configured to selectively regulate a flow of pressurized fluid to the second cylinder independently of the first cylinder.

In another aspect, the present disclosure is directed to a method of moving a work tool. The method may include receiving a first signal indicative of desired work tool tilting, receiving a second signal indicative of desired work tool pitching, and determining a valve position command based on the first and second signals. The method may also include simultaneously tilting and pitching the work tool based on the valve position command.

DETAILED DESCRIPTION

Figure 1:
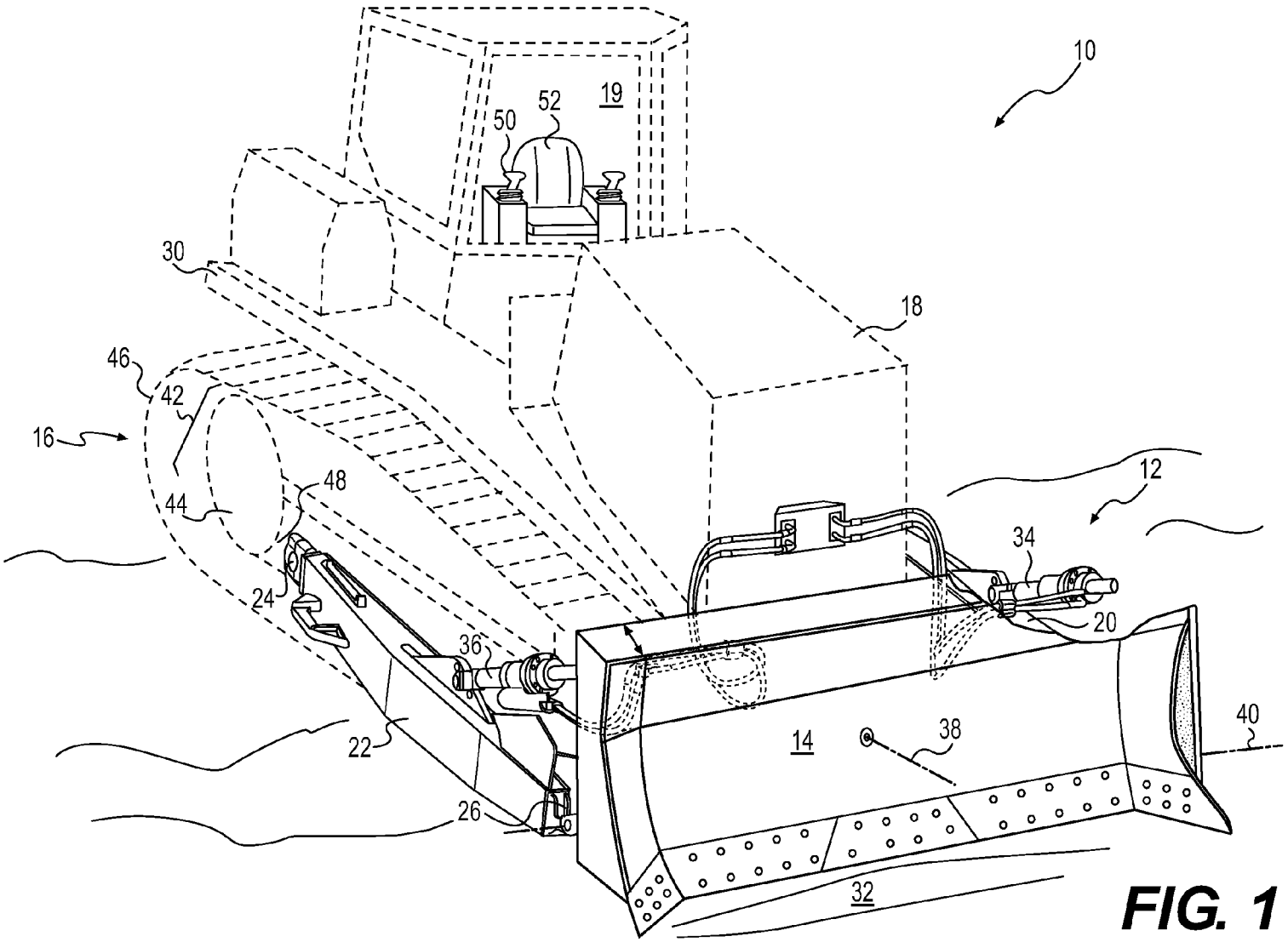
FIG. 1 is a pictorial illustration of an exemplary disclosed machine.

FIG. 1 illustrates an exemplary machine 10 having multiple systems and components that cooperate to accomplish a task. Machine 10 may embody a mobile machine that performs some type of operation associated with an industry such as mining, construction, farming, transportation, or another industry known in the art. For example, machine 10 may be a material moving machine such as a dozer, a motor grader, a snow plow, or similar machine. Machine 10 may include an implement system 12 configured to move a work tool 14, a drive system 16 for propelling machine 10, a power source 18 that provides power to implement system 12 and drive system 16, and an operator station 19 that provides for control of implement system 12, drive system 16, and/or power system 18.

Implement system 12 may include a linkage structure acted on by fluid actuators to move work tool 14. Specifically, implement system 12 may include left and right push arms 20, 22 that are pivotally connected at proximal ends 24 to drive system 16 and at opposing distal ends 26 to left and right base edges of work tool 14, respectively. A pair of opposing left and right hydraulic cylinders 34, 36 may be operatively connected between left and right upper edges of work tool 14 and center portions of left and right push arms 20, 22, respectively, to tilt and pitch work tool 14 relative to a frame 30. As will be described in more detail below, the extension or retraction of hydraulic cylinders 34, 36 by differing amounts and/or in differing directions may function to tilt work tool 14 in a vertical plane about a horizontal axis 38. In contrast, the extension or retraction of both hydraulic cylinders 34, 36 by an equal amount in the same direction may function to pitch work tool 14 in a vertical plane about a horizontal axis 40 that is substantially perpendicular to axis 38.

Numerous different work tools 14 may be attachable to a single machine 10 and operator controllable. Work tool 14 may include any device used to perform a particular task such as, for example, a blade, a bucket, a plow, or another task-performing device known in the art. Although connected in the embodiment of FIG. 1 to pivot in the vertical and horizontal directions relative to frame 30 of machine 10, work tool 14 may additionally lift, slide, swing, or move in any other manner known in the art.

Drive system 16 may include opposing undercarriage assemblies 42 (only one shown in FIG. 1), each having a sprocket 44 powered by power source 18 to rotate a corresponding endless track 46. Each undercarriage assembly 42 may also include a frame member 48 operatively connected to sprocket 44 and/or frame 30 to support the proximal end 24 of a corresponding one of left and right push arms 20, 22. It is contemplated that drive system 16 could alternatively include traction devices other than tracks 46 such as wheels, belts, or other known traction devices.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another known source. Power source 18 may produce a mechanical or electrical power output that is used to propel machine 10 via drive system 16 and can be converted to hydraulic power for moving hydraulic cylinders 34, 36.

Operator station 19 may include devices that receive input from a machine operator indicative of desired machine maneuvering. Specifically, operator station 19 may include one or more interface devices 50 located proximate a seat 52. Interface devices 50 may be manipulated by an operator to initiate movement of machine 10 by producing proportional displacement signals that are indicative of desired maneuvering. In one embodiment, interface device 50 may include a joystick associated with control of tilting and pitching movements of work tool 14. It is contemplated that an interface device 50 other than a joystick such as, for example, a pedal, a lever, a wheel, and other devices known in the art, may additionally or alternatively be provided within operator station 19 for movement control of machine 10, if desired.

Figure 2:
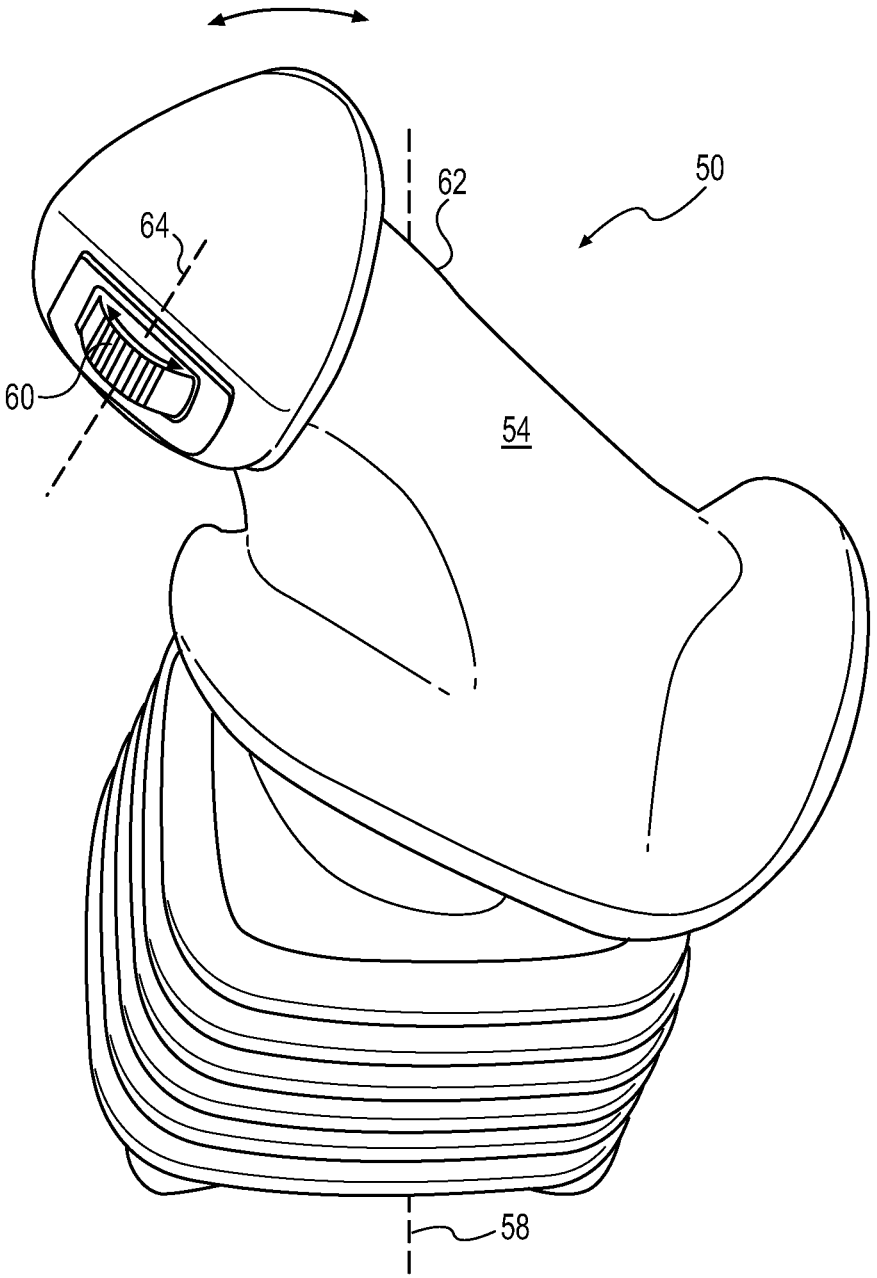
FIG. 2 is a pictorial illustration of an exemplary disclosed operator interface device that may be used in conjunction with the machine of FIG. 1.

As shown in FIG. 2, interface device 50 may include an inwardly-inclined (relative to seat 52 shown in FIG. 1) handle 54 that is pivotal in a vertical plane about a horizontal axis 58. When handle 54 is pivoted about horizontal axis 58 to the left or right, a first proportional signal may be generated indicative of desired tilting of work tool 14 by hydraulic cylinders 34, 36. Handle 54 may be spring-centered relative to horizontal axis 58. A thumb roller 60 may be located at a distal gripping end 62 of handle 54 and, when rotated about an axis 64, generate a second proportional signal indicative of desired pitching of work tool 14 by one or both of hydraulic cylinders 34, 36. Thumb roller 60 may be spring-centered about axis 64.

Figure 3:
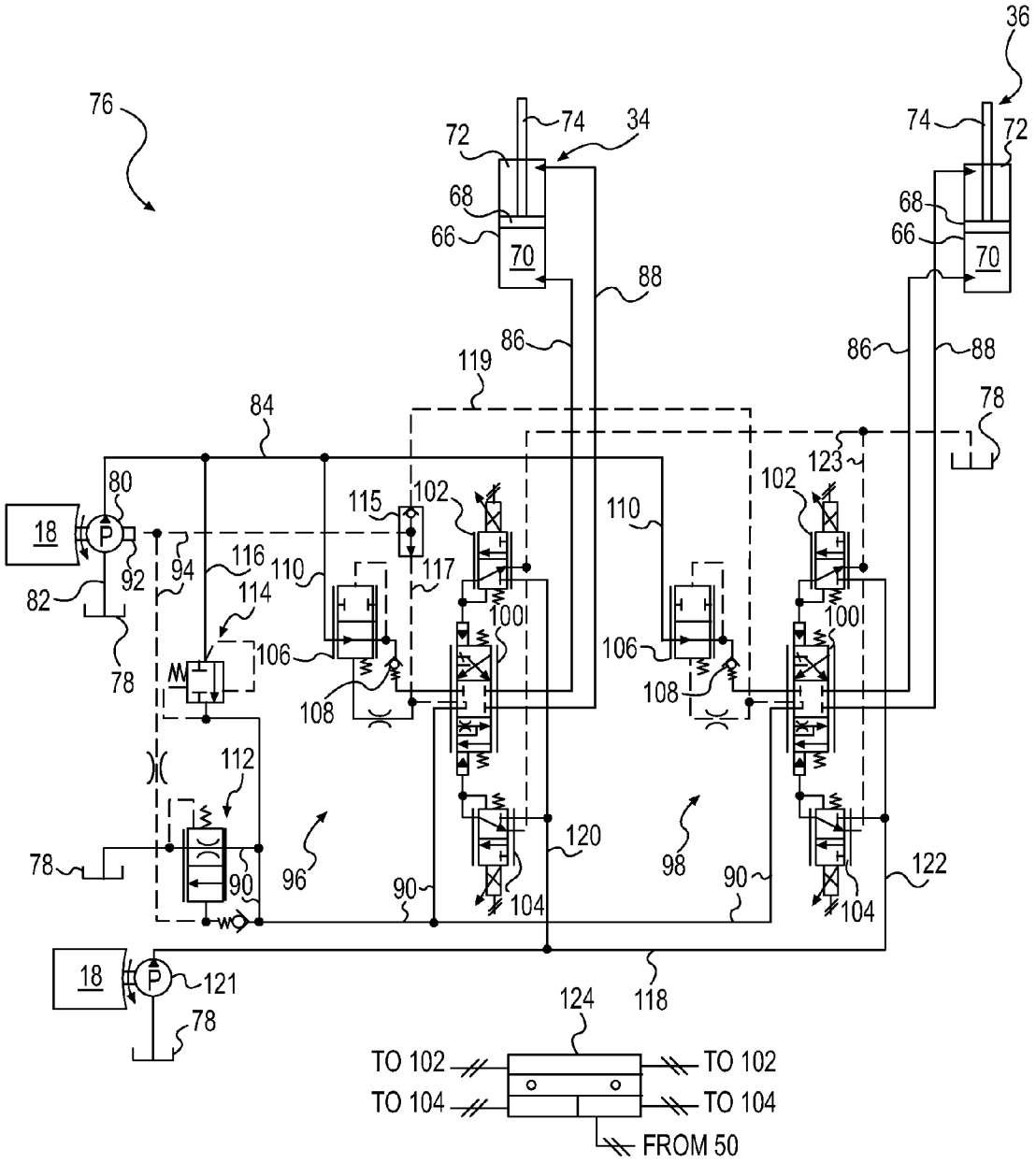
FIG. 3 is a schematic illustration of an exemplary disclosed hydraulic system that may be utilized with the machine of FIG. 1.

As shown in FIG. 3, each of hydraulic cylinders 34, 36 may include a tube 66 having a closed end operatively connected to one of push arms 22, 24 (referring to FIG. 1), and a piston assembly 68 having a rod 74 protruding through an open end of tube 66 for connection to work tool 14. Piston assembly 68 may be arranged with tube 66 to form a head-end pressure chamber 70 and a rod-end pressure chamber 72. Head- and rod-end pressure chambers 70, 72 may each be selectively supplied with pressurized fluid and drained of the pressurized fluid to cause piston assembly 68 and connected rod 74 to displace within tube 66, thereby changing an effective length of hydraulic cylinders 34 or 36. A flow rate of fluid into and out of head- and rod-end pressure chambers 70, 72 may relate to a velocity of hydraulic cylinders 34, 36, while a pressure differential between head- and rod-end pressure chambers 70, 72 may relate to a force imparted by hydraulic cylinders 34, 36 on work tool 14 (referring to FIG. 1).

Machine 10 may include a hydraulic system 76 having a plurality of fluid components that cooperate to cause the extending and retracting movements of hydraulic cylinders 34, 36 described above. Specifically, hydraulic system 76 may include a tank 78 holding a supply of fluid, and a primary source 80 configured to pressurize the fluid and selectively direct the pressurized fluid to each of hydraulic cylinders 34, 36. Primary source 80 may be connected to tank 78 via a tank passage 82, and to each hydraulic cylinder 34, 36 via a common supply passage 84 and separate head- and rod-end passages 86, 88. Tank 78 may be connected to each hydraulic cylinder 34, 36 via a common drain passage 90 and head- and rod-end passages 86, 88. Hydraulic system 76 may also include a plurality of valves located between hydraulic cylinders 34, 36 and tank 78 and primary source 80 to regulate flows of fluid through passages 84-90.

Primary source 80 may be configured to draw fluid from one or more tanks 78 and pressurize the fluid to predetermined levels. Specifically, primary source 80 may embody a pumping mechanism such as, for example, a variable displacement pump having a displacement actuator 92 that adjusts a displacement of primary source 80 based on a pressure of fluid within a load sense passage 94, a fixed displacement pump (not shown) having an unloader valve (not shown) that selectively reduces a load on primary source 80, or any other type of source known in the art. Primary source 80 may be connected to power source 18 of machine 10 by, for example, a countershaft, a belt (not shown), an electrical circuit (not shown), a reduction gear box (not shown), or in any other suitable manner.

Tank 78 may constitute a reservoir configured to hold a low-pressure supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 78. It is contemplated that hydraulic system 76 may be connected to multiple separate fluid tanks 78 or to a single tank 78, as desired.

The valves of hydraulic system 76 may be disposed within a common or separate valve blocks (not shown) and include, for example, a first electro-hydraulic valve 96 associated with hydraulic cylinder 34, and a second substantially identical electro-hydraulic valve 98 associated with hydraulic cylinder 36. First electro-hydraulic valve 96 may be disposed between head- and rod-end passages 86, 88 of hydraulic cylinder 34 and common supply and drain passages 84, 90. Second electro-hydraulic valve 98 may be disposed between head- and rod-end passages 86, 88 of hydraulic cylinder 36 and common supply and drain passages 84, 90

Each of first and second electro-hydraulic valves 96, 98 may include a pilot-operated main spool 100 and first and second paired solenoid-operated valve elements 102, 104. Main spool 100 may be movable between a first position at which a main flow of pressurized fluid from common supply passage 84 is allowed to pass to head-end pressure chamber 70 of its associated hydraulic cylinder 34 or 36 and waste fluid from rod-end pressure chamber 72 is allowed to pass to common drain passage 90, a second position at which the main flow of pressurized fluid from common supply passage 84 is allowed to pass to rod-end pressure chamber 72 and waste fluid from head-end pressure chamber 70 is allowed to pass to common drain passage 90, and a third position (shown in FIG. 3) between the first and second positions at which fluid flow through main spool 100 is inhibited. Main spool 100 may be spring-biased toward the third position and urged to any position between the third and first or third and second positions by a pressure of pilot fluid acting on opposing ends thereof (i.e., main spool 100 may be a proportional valve movable to any partial or fully open position by the pilot fluid). Each of first and second solenoid-operated valve elements 102, 104 may be separately associated with a particular end of main spool 100 and movable against a spring bias, when energized, from a first position at which the end of main spool 100 is communicated with pressurized pilot fluid, toward a second position (shown in FIG. 3) at which the end of main spool 100 is communicated with tank 78. When one end of main spool 100 is communicated with pressurized pilot fluid and the opposing end is communicated with tank 78, a pressure differential across main spool 100 may be created that urges main spool 100 to move toward one of the first and second positions.

In the disclosed embodiment, a pre-pressure compensating valve 106 and/or a check valve 108 may be disposed within a supply passage 110 that extends between common supply passage 84 and main spool 100 to provide a unidirectional supply of fluid having a substantially constant flow from primary source 80 into main spool 100. It is contemplated that, in some applications, pre-pressure compensating valve 106 and/or check valve 108 may be omitted or moved to another location within hydraulic system 76, as desired.

A pressure regulating valve 112 may be disposed within common drain passage 90 to provide a desired backpressure within hydraulic system 76. Pressure regulating valve 112 may be movable between flow-passing and flow-restricting positions based on a pressure differential between the fluid from load-sense passage 94 (or from hydraulic cylinders 34, 36, depending on which is higher) and the fluid draining into tank 78 via common drain passage 90. A pressure relief valve 114 may be disposed within a bypass passage 116 that connects common supply passage 84 to an inlet of pressure regulating valve 112. Pressure relief valve 114 may be movable between flow-passing and flow-blocking positions based on a pressure differential between the fluid from common supply passage 84 and the fluid from common drain passage 90.

Load sense passage 94 may be configured to direct a portion of the main flow of fluid (i.e., the fluid pressurized by primary source 80) from the one of main spools 100 that is exposed to higher pressures. In particular, load sense passage 94 may be connected to a supply port of each main spool 100 via a resolver 115 and individual load sense passages 117, 119 associated with each main spool 100. Resolver 115 may be configured to move based on a pressure differential between load sense passages 117, 119 to allow the higher pressure fluid to affect the displacement of primary source 80.

The flow of pilot fluid regulated by solenoid-operated valve elements 102, 104 to move main spool 100 may be provided by way of a pilot source 121, a common pilot passage 118, and individual pilot supply passages 120, 122. Similar to primary source 80, pilot source 121 may be configured to draw fluid from one or more tanks 78 and pressurize the fluid to predetermined levels. Pilot source 121 may embody a variable or fixed (shown in FIG. 3) displacement pump that is directly connected to power source 18 of machine 10 in any suitable manner. It is contemplated that pilot source 121 may be omitted and the flow of pilot fluid provided by primary source 80, if desired. Solenoid-operated valve elements 102, 104 may be connected to tank 78 via a pilot drain passage 123.

A controller 124 may be in communication with the different components of hydraulic system 76 to regulate operations of machine 10. For example, controller 124 may be in communication with each of solenoid-operated valve elements 102, 104 and with interface device 50 (referring to FIGS. 1 and 2). Based on the signals generated by interface device 50 during pivoting of handle 54 and manipulation of thumb roller 60, controller 124, as will be described in more detail below, may be configured to selectively activate different combinations of solenoid-operated valve elements 102, 104 to efficiently carry out operator commands. Controller 124 may include a memory, a secondary storage device, a clock, and one or more processors that cooperate to accomplish a task consistent with the present disclosure. Numerous commercially available microprocessors can be configured to perform the functions of controller 124. It should be appreciated that controller 124 could readily embody a general machine controller capable of controlling numerous other functions of machine 10. Various known circuits may be associated with controller 124, including signal-conditioning circuitry, communication circuitry, and other appropriate circuitry. It should also be appreciated that controller 124 may include one or more of an application-specific integrated circuit (ASIC), a field-programmable gate array (FPGA), a computer system, and a logic circuit configured to allow controller 124 to function in accordance with the present disclosure.

INDUSTRIAL APPLICABILITY

The disclosed hydraulic system may be used with any machine having a work tool that is capable of both tilting and pitching. The disclosed hydraulic system may be particularly useful when applied to a dozer having a blade where variable control over blade tilting and combined blade tilt/pitch maneuvers are beneficial. Variable control over blade tilting and combined blade tilt/pitch maneuvers may be possible through separate regulation of independent hydraulic cylinders. Operation of hydraulic system 76 will now be described in detail.

As shown in FIG. 3, hydraulic cylinders 34, 36 may be movable by fluid pressure. In particular, fluid may be drawn from tank 78, pressurized by primary source 80, and selectively directed to main spool(s) 100 via common supply passage 84. In response to an operator manipulation of interface device 50, controller 124 may selectively energize one of solenoid-operated valve elements 102, 104 to cause the associated main spool(s) 100 to move toward the first or second positions and direct the main flow of pressurized fluid to the appropriate one of head- and rod-end pressure chambers 70, 72. Substantially simultaneously, controller 124 may selectively de-energize the other of solenoid-operated valve elements 102, 104 to cause the associated main spool(s) 100 to move and fluidly communicate the other head- and rod-end pressure chambers 70, 72 of the same cylinder with tank 78 via common drain passage 90, thereby creating a force differential across piston assembly 68 that causes piston assembly 68 to move.

For example, if a retraction of hydraulic cylinder 34 is requested, solenoid-operated valve element 102 may be energized by controller 124 to move toward its first position and direct pressurized fluid from primary source 80 to its associated end of main spool 100. Substantially simultaneously, the solenoid-operated valve element 104 may be de-energized by controller 124 and spring-biased toward its second position to allow fluid from its associated end of mail spool 100 to drain to tank 78. By directing pressurized fluid to the valve 102-end of main spool 100 and draining fluid from the valve 104-end of main spool 100, a pressure differential across main spool 100 may be created that causes main spool 100 to move away from solenoid-operated valve element 102 and toward solenoid-operated valve element 104 (i.e., to move toward its second position). When main spool 100 is in the second position, as described above, pressurized fluid from primary source 80 may be directed into rod-end pressure chamber 72 while fluid from head-end pressure chamber 70 may be drained of fluid, thereby creating a pressure differential across piston assembly 68 that causes hydraulic cylinder 34 to retract. An extension of hydraulic cylinder 34 may be performed in a similar manner and, therefore, will not be described in detail in this disclosure. Extensions and retractions of hydraulic cylinder 36 may also be performed in a similar manner and will therefore also not be described in further detail in this disclosure.

Hydraulic cylinders 34, 36 may be cooperatively extended or retracted to generate a dual-action tilt to the left, a dual-action tilt to the right, a forward pitch, a rearward pitch, and a combination tilt/pitch to the left or right and forward or rearward. For example, to generate the dual-action tilt to the left, hydraulic cylinder 34 may be retracted while hydraulic cylinder 36 may be extended. Retraction of hydraulic cylinder 34 may result in the left edge of work tool 14 being pulled downward relative to machine 10, while extension of hydraulic cylinder 36 may result in the right edge of work tool 14 being pushed upward relative from machine 10. The combined downward movement of the left edge of work tool 14 and upward movement of the right edge of work tool 14 may function to tilt work tool 14 to the left, as viewed from an operator's perspective. A simultaneous retraction of hydraulic cylinder 36 at the right edge of work tool 14 and extension of hydraulic cylinder 34 at the left edge of work tool 14 may function to tilt work tool 14 to the right. Simultaneous movements of hydraulic cylinders 34 and 36 may result in a large range of work tool tilting with high force. Work tool 14 may be caused to pitch forward by the simultaneous equal extension of both hydraulic cylinders 34, 36, and rearward by the simultaneous equal retraction of both hydraulic cylinders 34, 36. The combination tilt/pitch motion to the left or right may be achieved by simultaneously extending or retracting both hydraulic cylinders 34, 36, but by differing amounts. For example, to tilt work tool 14 to the left while pitching work tool 14 forward, both hydraulic cylinders 34, 36 may be extended, but with hydraulic cylinder 36 extending at a greater rate. Similarly, to tilt work tool 14 to the right while pitching work tool 14 rearward, both hydraulic cylinders 34, 36 may be retracted, but with hydraulic cylinder 34 retracting at a slower rate.

Hydraulic cylinders 34, 36 may each be independently extended or retracted to generate a single-action tilt of work tool 14 to the left or to the right. The single-action tilting of work tool 14 may be beneficial when a failure of one of hydraulic cylinders 34, 36 or associated valving has occurred that makes dual-action tilting impractical. For example, when a communication failure between first and/or second solenoid-operated valve elements 102, 104 of hydraulic cylinder 34 has occurred, controller 124 may detect the failure and responsively command only hydraulic cylinder 36 to extend or retract and thereby tilt work tool 14 in the desired manner, and vice versa. Although the resulting tilting may have a smaller range of motion and/or a smaller associated force, this functionality may still provide a "limp home" capability.

Controller 124 may implement one or more algorithms and/or maps stored in memory to regulate movements of each solenoid-operated valve element 102, 104 based on input received from interface device 50 to control the corresponding movements of work tool 14 in a manner desired by the machine operator. For example, when an operator only pivots handle 54 to the left to a position about half way through its range from its centered position, a proportional first signal requesting a left tilt of work tool 14 at about 50% of a maximum speed may be generated by interface device 50 and directed to controller 124. Upon receiving the first signal, controller 124 may normalize the signal (i.e., convert the signal to a standard value between −1000 and zero or between zero and +1000 for each hydraulic cylinder 34, 36 depending on the pivot direction) according to one or more preprogrammed algorithms. In this example, pivoting handle 54 leftward to the 50% position may result in a normalized value for hydraulic cylinder 34 of about −500 and a normalized value for hydraulic cylinder 36 of about +500. Controller 124 may then reference the normalized values with one or more modulation maps stored in memory to determine corresponding valve position commands directed to solenoid-operated valve elements 102, 104 causing hydraulic cylinder 34 to retract and hydraulic cylinder 36 to extend in opposing directions at substantially equal speeds.

Manipulation of only thumb roller 60 may be treated in the same general manner by controller 124. For example, when an operator only rotates thumb roller 60 to the right to a position about one-quarter through its range from its centered position, a proportional second signal requesting a forward pitch of work tool 14 at about 25% of a maximum speed may be generated by interface device 50 and directed to controller 124. Upon receiving the second signal, controller 124 may again normalize the signal. In this example, rotating thumb roller 60 to the right to the 25% position may result in a normalized value for both hydraulic cylinder 34, 36 of about +250. Controller 124 may then reference the normalized values with one or more modulation maps stored in memory to determine corresponding valve position commands directed to solenoid-operated valve elements 102, 104 causing both hydraulic cylinders 34, 36 to extend at substantially equal speeds.

When handle 54 is tilted and thumb roller 60 is also simultaneously moved away from its centered position, controller 124 may generate combined valve position commands that are functions of both the first and second signals. For example, when handle 54 is tilted to the left 50% position and thumb roller 60 is simultaneously rotated to the right 25% position, controller 124 may generate normalized values of −500 (tilt value) and +250 (pitch value) for hydraulic cylinder 34, and +500 (tilt value) and +250 (pitch value) for hydraulic cylinder 36. Before referencing the modulation maps stored in memory, as normally performed by controller 124 when only tilting or only pitching is requested, controller 124 may instead first sum the normalized values. In the disclosed example, the normalized values would sum to −250 for hydraulic cylinder 34 and +750 for hydraulic cylinder 36. These sums may then be referenced by controller 124 with the modulation maps to determine corresponding valve position commands directed to solenoid-operated valve elements 102, 104 causing hydraulic cylinder 34 to retract at a first slower speed and hydraulic cylinder 36 to extend at a second faster speed. The unequal retraction/extension of hydraulic cylinders 34, 36 may result in a combined left tilting/forward pitching motion of work tool 14.

In some applications, it may be desirable to scale the valve position commands before they are directed to solenoid-operated valve elements 102, 104. Scaling the valve position commands may increase control over work tool 14 and allow modulation of hydraulic cylinders 34, 36 to be tuned for different machines in different applications. In the disclosed embodiment, the scaling may be different when the first or second signal is received alone, versus when the two signals are received at the same time. For example, when only one of the first and second signals requesting only tilting or only pitching of work tool 14 is received, controller 124 may scale down the valve position commands by about 50% before directing the valve position commands to solenoid-operated valve elements 102, 104. In contrast, when the first and second signals are simultaneously received, controller 124 may scale down the valve position commands by only about 20%. The different levels of scaling may improve responsiveness during the combined tilt/pitch movements of work tool 14.

Because hydraulic system 76 may be capable of simultaneously tilting and pitching work tool 14, efficiency, productivity, and ease of use of machine 10 may be increased. For example, when both a tilt and pitch operation of work tool 14 are required, the operator may no longer be required to wait until work tool 14 has finished tilting to the desired angle before initiating pitching of work tool 14. By eliminating the wait time of the operator, the operator may be able to more quickly initiate and complete the task at hand, thereby improving the efficiency and productivity of machine 10. In addition, it may be easier for the operator to position work tool 14 exactly where desired with a single input action when both tilting and pitching movements are performed simultaneously, as opposed to tilting work tool 14, then pitching work tool 14, then adjusting the tilt, and so forth.

The ability to separately and independently control hydraulic cylinder 34 and hydraulic cylinder 36 to tilt work tool 14, may provide some functionality even during failure of one of the cylinders. This functionality may allow the operator to complete the task at hand before bringing machine 10 in for service and/or at least allow the operator to move the malfunctioning work tool 14 to a desired position for safe and efficient travel to a service area.

It will be apparent to those skilled in the art that various modifications and variations can be made to the hydraulic system of the present disclosure without departing from the scope of the disclosure. Other embodiments will be apparent to those skilled in the art from consideration of the specification and practice of the hydraulic system disclosed herein. It is intended that the specification and examples be considered as exemplary only, with a true scope of the disclosure being indicated by the following claims and their equivalent.

What is claimed is:

1. A hydraulic system for a machine, comprising:

a tank configured to hold a supply of fluid;

a pump configured to draw fluid from the tank and pressurize the fluid;

a first cylinder operatively connected between a first side of a work tool and a first undercarriage assembly of the machine;

a second cylinder operatively connected between a second side of the work tool and a second undercarriage assembly of the machine;

a first electro-hydraulic valve associated with the first cylinder and configured to selectively regulate a flow of pressurized fluid to the first cylinder independently of the second cylinder;

a second electro-hydraulic valve associated with the second cylinder and configured to selectively regulate a flow of pressurized fluid to the second cylinder independently of the first cylinder;

an operator interface device configured to generate signals that are indicative of desired work tool movement when manipulated by an operator, and a controller in communication with each of the first and second electro-hydraulic valves and the operator interface device, the controller being configured to:

selectively generate valve position commands directed to the first and second electro-hydraulic valves that result in a single-action left tilt, a dual-action left tilt, a single-action right tilt, a dual-action right tilt, a pitch, and a combination tilt/pitch of the work tool;

receive a first signal indicative of a desired tilting of the work tool and a second signal indicative of a desired pitching of the work tool;

generate combined valve position commands directed to the first and second electro-hydraulic valves that are functions of the first and second signals;

normalize the first and second signals and sum normalized values of the first and second signals to determine the combined valve position commands;

reference sums of the normalized values with a relationship map stored in memory to determine the combined valve position commands;

reduce the valve position commands by an amount when the first and second signals are received separately; and reduce the combined valve position commands by a lower amount when the first and second signals are received simultaneously.

2. The hydraulic system of claim 1, wherein:

the first electro-hydraulic valve includes:

a first main spool that is pilot-operated to move between a first position at which pressurized fluid from the pump is directed to a head-end of the first cylinder and fluid from a rod-end of the first cylinder is directed to the tank, a second position at which pressurized fluid from the pump is directed to the rod-end of the first cylinder and fluid from the head-end of the first cylinder is directed to the tank, and a third position at which fluid flow through the main spool is inhibited; and at least a first solenoid-operated valve element movable from a first position at which an end of the first main spool is connected to pressurized pilot fluid, and a second position at which the end of the first main spool is connected to the tank; and the second electro-hydraulic valve includes:

a second main spool that is pilot-operated to move between a first position at which pressurized fluid from the pump is directed to a head-end of the second cylinder and fluid from a rod-end of the second cylinder is directed to the tank, a second position at which pressurized fluid from the pump is directed to the rod-end of the second cylinder and fluid from the head-end of the second cylinder is directed to the tank, and a third position at which fluid flow through the second main spool is inhibited; and at least a second solenoid-operated valve element movable from a first position at which an end of the second main spool is connected to pressurized pilot fluid, and a second position at which the end of the second main spool is connected to the tank.

3. The hydraulic system of claim 2, wherein:

each of the first and second main spools are spring-biased toward the third position; and each of the first and second solenoid-operated valve elements are spring biased toward the second position.

4. The hydraulic system of claim 2, wherein:

the end of the first main spool is a first end;

the end of the second main spool is a first end;

each of the first and second main spools includes a second end opposite the first end;

the at least a first solenoid-operated valve element includes:

a first solenoid-operated valve element associated with the first end of the first main spool; and a second solenoid-operated valve element associated with the second end of the first main spool; and the at least a second solenoid-operated valve element includes:

a first solenoid-operated valve element associated with the first end of the second main spool; and a second solenoid-operated valve element associated with the second end of the second main spool.

5. The hydraulic system of claim 4, further including:

a first pre-pressure compensating valve associated with the first main spool; and a second pre-pressure compensating valve associated with the second main spool.

6. The hydraulic system of claim 2, further including a pilot pump configured to draw fluid from the tank, pressurize the fluid, and direct pressurized fluid to the at least a first solenoid-operated valve and to the at least a second solenoid operated valve.

7. The hydraulic system of claim 1, wherein the work tool is a blade mounted to a front end of the machine.

8. The hydraulic system of claim 1, wherein the operator interface device includes a joystick pivotal to generate the first signal and having a thumb roller movable to generate the second signal.

9. A method of moving a work tool, comprising:

receiving a first signal indicative of desired work tool tilting;

receiving a second signal indicative of desired work tool pitching;

determining valve position commands based on the first and second signals;

reducing the valve position commands by an amount when the first and second signals are received separately;

reducing the valve position commands by a lower amount when the first and second signals are received simultaneously; and simultaneously tilting and pitching the work tool based on the valve position commands, wherein determining the valve position commands includes normalizing the first and second signals, summing normalized values of the first and second signals, and referencing sums of the normalized values with a relationship map stored in memory.

10. The method of claim 9, further including separately implementing a single-action left tilt, a dual-action left tilt, a single-action right tilt, a dual-action right tilt, and a pitch based on the first and second signals.

* * * * *